United States Patent [19]

Manton

[11] Patent Number: 4,740,255

[45] Date of Patent: Apr. 26, 1988

[54] HIGH STRENGTH WELDABLE SEAMLESS TUBE OF LOW ALLOY STEEL

[76] Inventor: Robert B. Manton, 9726 E. 42nd St., Suite 211, Tulsa, Okla. 74146

[21] Appl. No.: 840,064

[22] Filed: Mar. 17, 1986

[51] Int. Cl.[4] ..... C22C 38/22

[52] U.S. Cl. ..... 148/334; 148/335; 148/328; 148/909; 428/586

[58] Field of Search ..... 148/36, 12 B, 909, 334, 148/335, 328; 75/123 L, 123 G, 123 E; 420/106, 108, 109, 111; 138/DIG. 6, 134; 175/409; 428/586

[56] References Cited

U.S. PATENT DOCUMENTS 4,282,047 8/1981 Yamagata et al. ..... 148/36

FOREIGN PATENT DOCUMENTS 55-97423 7/1980 Japan ..... 148/36

*Primary Examiner*—Deborah Yee

*Attorney, Agent, or Firm*—Head & Johnson

[57] ABSTRACT

A high strength electric furnace, vacuum degassed and weldable seamless tube of low alloy steel containing 0.22 to 0.28% carbon, 1.20 to 1.4% manganese, not more than 0.035% phosphorus, not more than 0.02 sulphur, 0.15 to 0.35% silicon, 0.20 to 0.30% chromium, not more than 0.05% nickel, 0.15 to 0.60% molybdenum, 0.02 to 0.04% titanium, 0.0007 to 0.0025% boron, 0.007 to 0.050% aluminum and the balance iron. Where the pipe has a wall thickness of 1⅛ inch or less the percentage molybdenum is preferably 0.15 to 0.20% whereas if the wall thickness is 1.18 inches or greater the preferred molybdenum content is 0.40 to 0.60%. The pipe is preferably heated to an austenization temperature of about 1,550° F. followed by simultaneous internal and external quenching and tempering at a temperature of about 1140° F.

2 Claims, 3 Drawing Sheets

HIGH STRENGTH WELDABLE SEAMLESS TUBE OF LOW ALLOY STEEL

SUMMARY OF THE INVENTION

The present invention relates to a new type of electric furnace, vacuum degassed seamless hot finished, quenched and tempered mechanical tube. By utilizing a unique chemical analysis, coupled with a very specific heat treatment cycle, this tube is capable of meeting stringent mechanical property requirements required for use in the petroleum industry. American Petroleum Institute Specification 5A is a governing specification for casing tubing and drill pipe and is applied to other applications such as casing cementing equipment.

The subject of boron steels, and those utilizing elements such as chromium and molybdenum has been widely investigated and a number of patents have been issued. One of the landmark patents in metallurgical engineering of the last 25 years is U.S. Pat. No. 2,858,206 which disclosed the alloy known commercially as (USST-1), United States Steel T-1 which was the basis for ASTM specification A-514/517. The alloy of this invention is similar in terms of alloy system to the USST-1 but there are differences in other areas which will be discussed later. USST-1 is a plate product of essentially 90,000 psi yield strength. Many other patents were later granted to those who invented alloys based on the boron, molybdenum, chromium hardening schemes pioneered by the USST-1. The Armco SSS-100 steel product, disclosed in U.S. Pat. No. 3,288,600 is a variation of the T-1 steel. The chromium content is higher along with a higher molybdenum range.

Bethlehem Steel later entered the market with its own version of the T-1, disclosed in U.S. Pat. No. 3,508,911. This steel was very similar to the T-1 except for a different molybdenum range and nickel content, which was added in an attempt to enhance low temperature toughness.

The Japanese developed their own version of the T-1 (U.S. Pat. No. 3,592,633). All of these steels are basically the same, 100,000 psi yield strength plate although some of the patents claim any article made from the claimed alloy.

Another prior art alloy is a UNSK 12125, (0.24C, 1.4Mn, 0.51Cr, 0.17Mo, 0.0013B). This alloy is another example of boron steel technology, however, the typical strengths (95 ksi yield) are generally less than that of the present invention and the chemistry is not similar in the areas of chromium and molybdenum.

A problem with tubing currently known is that in heavy wall sections, such as found in oil well casing cementing equipment applications, it is difficult to achieve the strength levels desired throughout the wall section without having a highly alloyed tube. Such high strength levels are required for certain tubing grades in the API specification.

Hardenability is a term that refers to the depth of hardening or to the size of piece that can be hardened under given cooling conditions. In the case of a quench and temper heat treatment, the cooling conditions include the rate of cooling experienced in the quenchant by the piece being heat treated. Under given constant cooling conditions, the hardenability of a steel can be changed by changing the chemical composition. Additions of alloying elements such as manganese, chromium, nickel, etc., will increase the hardenability of a steel. Increase in the chromium, carbon and nickel content has been a common technique used heretofore in the industry to achieve mechanical properties as required in specifications such as the API 5A specification. Some of the disadvantages of this approach include the possibility that some alloying elements may be detrimental from a corrosion standpoint when present in certain quantities and that higher alloy element content results in poor weldability of the base metal. Some applications of seamless mechanical tubing in the petroleum industry requires good weldability under field conditions.

Weldability can be characterized in terms of a term called the carbon equivalent. According to the American Welding Society 1, the carbon equivalent can be expressed as follows:

$$\%CE = \%C + \%Mn/4 + \%Ni/20 + \%Cr/10 - \%Mo/50 - \%V/10 + \%Cu/40$$

In general, the higher the carbon equivalent value, the poorer the weldability of the base metal from the standpoint of a susceptability to cracking. Known metal chemistries used heretofore to provide acceptable strength levels such as an AISI 4140 steel will have a carbon equivalent of 0.706 while the present invention presents a carbon equivalent of 0.636.

The seamless pipe of the present invention does not contain alloying elements in sufficient quantity to induce corrosion problems or exceed the established parameters that constitute good weldability. When produced according to specific processing parameters, including proper heat treatment, the resultant product meets the requirements of industry standards for applications not currently served by known tubing alloys.

Known chemical analyses rely heavily on high carbon and chromium contents to achieve the desired hardenability levels. A number of transformation products are possible in a steel when hardening by quenching is attempted. In order to achieve high levels of hardenability a proper proportion of elements that retard the transformation of a phase known as ferrite and promote bainite and martensite phase transformation is needed.

Molybdenum is known as an element that retards the formation of the ferrite phase. Boron also has an effect, retarding the nucleation of ferrite at grain boundaries in the metal. The synergistic effect of these two elements has been documented to show a very significant retardation of ferrite in favor of the more desirable bainite phase Some of these principles are known, but industry has not widely employed these chemical analyses systems for the commercial product or of seamless mechanical tubing. The principle reason is that boron can be affected by the nitrogen content of a steel. Nitrogen is, for the most part, an element that is found in varying quantities in all air melted steels. Nitrogen can kill the effectiveness of boron by tying the boron up in the form of an undesirable compound known as boron nitride (BN). The present invention makes use of an addition of titanium to control nitrogen; titanium nitrides and titanium carbonitrides will form preferentially to boron nitride. This allows the free boron to perform its necessary hardenability roles. The present invention makes use of precise management of nitrogen levels. By knowing the level of nitrogen, the necessary level of titanium needed in order to insure the required effective boron content can be determined by relationships such as:

$$\text{Boron (eff)} = \text{Boron(tot)} - [(\%N - 0.002) - (Ti/5)]$$

The tempering temperatures used in the present invention by virtue of the molybdenum content, achieve the desired mechanical properties and are high enough to provide a good dimensionally stable alloy for use in making machined parts.

The present invention comprises a high strength low alloy, hot-finished, seamless, mechanical tubing consisting essentially of:

| | <1⅛" wall | >1⅛" wall |
|---|---|---|
| Carbon | .22 to .26% | .24 to .28% |
| Manganese | 1.20 to 1.40% | 1.20 to 1.40% |
| Phosphorous | .035% max. | .035% max |
| Sulfur | .020 max. | .020 max. |
| Silicon | .15 to .35% | .15 to .35% |
| Chromium | .20 to .30% | .20 to .30% |
| Nickel | .050% max. | .05% max. |
| Molybdenum | .15 to .20% | .40% to .60% |
| Titanium | .02 to .04% | .02 to .04% |
| Boron | .0007 to .0025% | .0007 to .0025% |
| Aluminum (solution) | .007 to .050% | .007 to .050% |

Such tubing shall be given a heat treatment consisting of a quench from above a sufficiently high austenization temperature and tempering at a temperature of essentially 1140 F.

The present invention will be more readily understood with reference to the description hereafter set forth, in conjunction with the accompanying drawings.

DESCRIPTION OF THE PREFERRED EMBODIMENT

Figure 1:
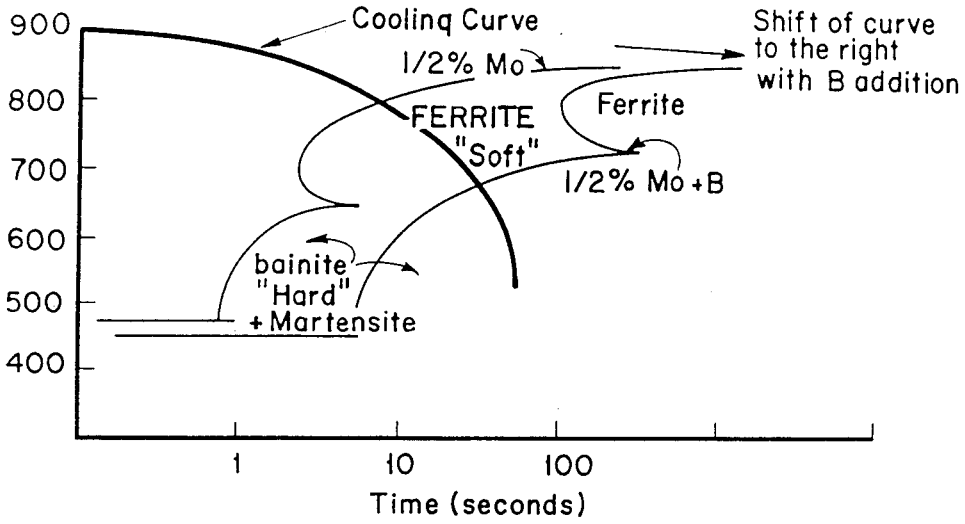
FIG. 1 is a transformation diagram showing how the addition of boron shifts the start phase formation in an alloy.

Most steels harden when quenched from an elevated temperature, the reason for this is that iron can exist in different crystal structures depending on temperature. By altering alloying elements and cooling rates from one phase region to the next, a shear reaction can occur, the resultant crystal structure can often be quite stronger than in the same metal before heat treatment. The relationship of these phases to cooling rate can be visualized on a diagram called a "continuous cooling transformation" diagram, such as shown in FIG. 1.

Carbon is the most effective element known for shifting the nose of the CCT diagram to increase the hardening capacity of a steel. The disadvantage of carbon lies in decreased ductility, increased probability of cracking, and poor weldability. There also is a limit to the amount of carbon that can be placed in iron. A great deal of effort has been expended in the metallurgical community over the last 50 years to develop alloys with different proportions of alloying elements to achieve the desired performance with the attendant economic considerations.

The alloy of the present invention achieves high strength through a quench and temper heat treatment. The hardenability of this steel, or its ability to achieve high strength in thick sections, is principally derived from the element molybdenum, combined with boron and a chromium addition. Manganese also contributes to the overall hardenability. Elements such as Ti may contribute to a mechanism known as precipitation hardening. The titanium is present to help preserve the hardenability effects of boron. Boron has not received wide use as an alloying element because it is hard to work with in the steel making environment.

The relative response to heat treatment of a steel can be measured through a test known as the Jominy End Quench test. In this test a water jet is directed against the end of a bar of interest that has been heated to a temperature sufficient to allow the entire bar to be transformed to the crystal structure that is at least theoretically capable of making the shear (hardening) transformations.

Figure 2:
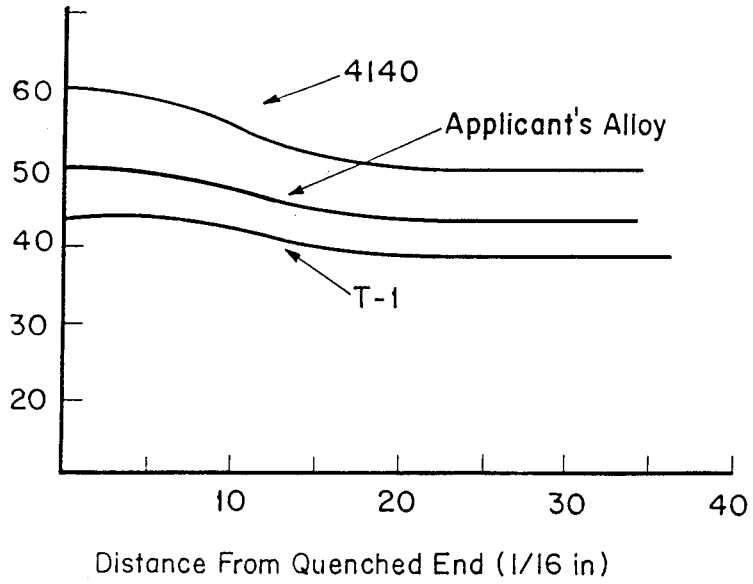
FIG. 2 shows curves of a Jominy Quench test for three different alloys, one being that of the present invention.
Figure 3:
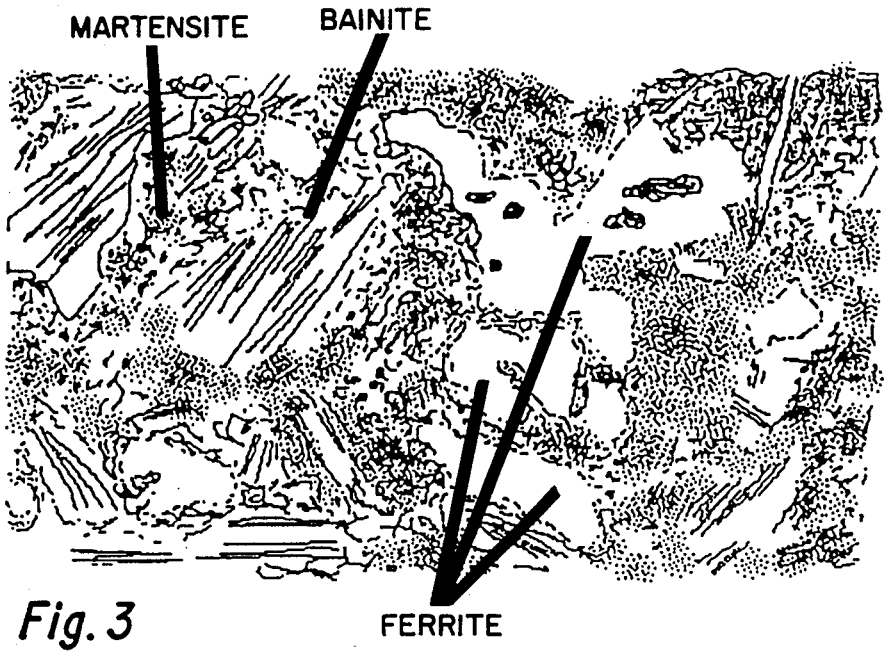
FIG. 3 is a drawing depicting the micro-structure typical of that found in the center section of thick wall tubes exhibiting poor mechanical properties (i.e., low tensile strength and toughness).

Hardness measurements are taken after complete cooling. These hardnesses are indicative of the final crystal structures. The cooling rates along the axis of the bar vary from extremely fast at the quench face to a slow cooling rate, as would be expected at the center of a very massive part to be heat treated. As shown in FIG. 2, the curve for a Jominy Quench test of an AISI 4140 steel is compared to the alloy of the present invention and an alloy that is chemically similar to a USST-1 plate steel. The AISI 4140 is an alloy (chromium, molybdenum hardening scheme) that has reasonably good heat treat response. This steel will achieve strengths sufficient to meet many of the performance requirements of the modern oil industry, however, this steel has a total alloy content that leads to poor weldability and poses many other operational problems such as susceptibility to cracking that has curtailed its use. From these plots it can be seen that the alloy of the present invention exhibits a quench response lower than the AISI 4140, but higher than the similar T-1 as well as higher than most other chromium, molybdnum steels.

There are many types and grades of mechanical tubing currently produced for applications such as petroleum industry casing, tubing and drill pipe. Generally, in order to obtain high tensile strength in a consistent fashion throughout a tube wall, manufacturers have used metal chemistries consisting of carbon (% C>0.30), chromium (% Cr>0.75), and nickel (% Ni>0.50). Tubing with this class of chemistry can often result in poor weldability.

The present invention is an electric furnace, vacuum degassed seamless tube of low alloy steel which has the following chemical analysis:

| | <1⅛" wall | >1⅛" wall |
|---|---|---|
| Carbon, | .22 to .26% | .24 to .28% |
| Manganese | 1.20 to 1.40% | 1.20 to 1.40% |
| Phosphorous | .035% max. | .035% max |
| Sulfur | .020% max. | .020% max. |
| Silicon | .15 to .35% | .15 to .35% |
| Chromium | .20 to .30% | .20 to .30% |
| Nickel | .050% max. | .05% max. |

-continued

| | <1⅛" wall | >1⅛" wall |
|---|---|---|
| Molybdenum | .15 to .20% | .40% to .60% |
| Titanium | .02 to .04% | .02 to .04% |
| Boron | .0007 to .0025% | .0007 to .050% |
| Aluminum (solution),. | .007 to .050% | .007 to .050% |

The electric furnace melted and vacuum degassed tubing is given an austenization treatment at a temperature above the transformation temperature for hardening. An ID plus OD quench is utilized to give a very fast cooling rate even at the center of thick walls. The low alloy nature of the chemical analysis prevents cracking even at high rates of quench.

The minimum mechanical properties after OD and ID quench and after tempering at substantially 1140° F. are as follows:

| | |
|---|---|
| Ultimate Tensile Strength | 125,000 psi |
| Yield Strength | 115,000–135,000 psi |
| Elongation | 19% strip specimen<br>15% round specimens |
| Hardness | 30–33 Rockwell C |

Actual testing has shown tensile and hardness values consequently fall within these limits.

For petroleum industry applications such as those encompassed by the API 5A standard, the following requirements are set for a grade P-110 mechanical tube:

| | |
|---|---|
| Ultimate Tensile Strength | 125,000 psi min. |
| Yield Strength | 110,000–140,000 psi |
| Elongation | 15% min strip specimen |

Figure 4:
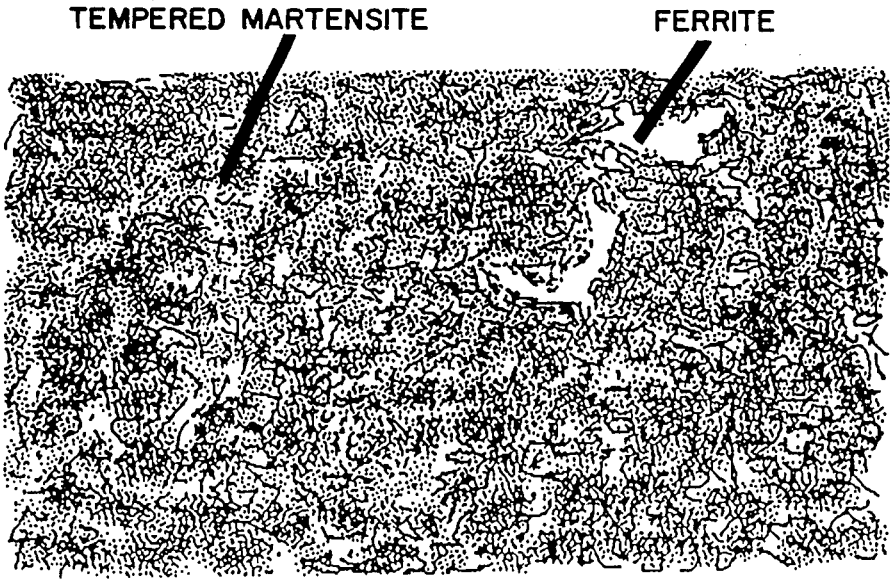
FIG. 4 is a drawing depicting the micro-structure found in the center sections of thick wall tubes that constitute the present invention.
Figure 5:
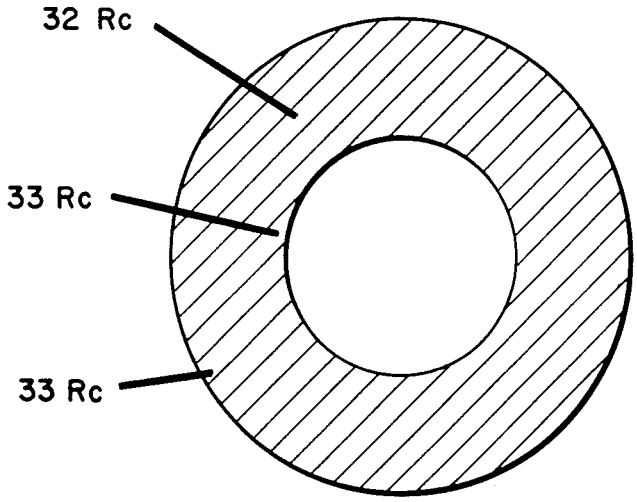
FIG. 5 is a drawing showing the small variation in hardnesses which can be directly related to mechanical properties that are a characteristic of the present invention.

Tubing currently known to meet the above requirements generally contains carbon greater than 0.30%. and chromium greater than 0.50%. Even with the higher alloying content, the micro-structures of these tubes are not consistent throughout the wall section as indicated in FIG. 1. In FIG. 1 ferrite transformation phases may be present as shown. For the present invention, a unique chemical analysis coupled with an OD and ID quench results in a micro-structure that consists of a tempered martensite throughout the wall section as depicted in FIG. 4. The unique chemical analysis combination suppresses the nucleation of any ferrite transformation products promoting the bainite and martensite transformation products. This consistent microstructure results in hardnesses that are within three Rockwell C points throughout heavy wall sections, this is depicted in FIG. 5.

The present invention also offers good weldability which can be required for some applications in the petroleum industry. The American Welding Society defines weldability in terms of carbon equivalent, based on chemical analysis. Carbon equivalent can be expressed as follows:

$$\%CE=\%C+\%Mn/4+\%Ni/20+\%Cr/10-\%Mo/50-\%V/10+\%Cu/40$$

In general, the higher the carbon equivalent value, the poorer the weldability of the base metal for a standpoint of a susceptibility to cracking. Known metal chemistries used heretofore to provide acceptable strength levels such as an AISI 4140 steel will have a carbon equivalent of 0.706 while the present invention presents a carbon equivalent of 0.636 enhancing weldability.

Alloys used for production of oilfield-type seamless tubing have been essentially the same in terms of metallurgical theory having essentially the same chemical composition as the present invention with some notable exceptions:

A. While the subject invention can be characterized as a hypoeutectoid boron steel containing small quantities of aluminum and titanium as is the case with known steel alloys, the alloy of the present invention contains neither vanadium or columbium. Most prior art steels will contain one or both of these elements. The lack of vanadium in the present alloy is desirable in terms of resistance to temper embrittlement. Vanadium is used to increase yield and tensile strength as is columbium, but both elements are expensive alternatives to the formulation of the present alloy without the potentially deleterious effects. Particular attention should be given to sulfur contents. Sulfur is a contaminant that adversely affects toughness, corrosion resistance and weldability. Prior art steels generally allow higher levels of sulfur than allowed in the present alloy.

B. The tensile properties of the present alloy are unique when compared to prior art steels. The yield strength is 115,000 psi to 135,000 psi. This yield strength is unique in terms of the minimum value and the total range that the invention may exhibit. Prior art steels typically exhibit only 100,000 psi yield while the present alloy exhibits a higher minimum.

C. The present alloy provided a restricted hardness range not known in other alloys.

D. The present alloy has better dimensional stability than prior art steels. This can be substantiated through the literature (i.e., high tempering temperatures lead to better stability).

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An electric furnace melted, vacuum degassed high strength weldable seamless tube of wall thickness less than 1⅛" which has been heated to an austenization temperature of about 1,550° F. and simultaneously internally and externally quenched and tempered at substantially 1,140° F. and has a composition consisting essentially of 0.22 to 0.26% carbon, 1.20 to 1.4% manganese, not more than 0.035% phosphorus, not more than 0.02% sulphur, 0.15 to 0.35% silicon, 0.20 to 0.30% chromium, not more than 0.05% nickel, 0.15 to 0.20% molybdenum, 0.02 to 0.04% titanium, 0.0007 to 0.0025% boron, 0.007 to 0.050% aluminum and the balance iron and wherein said tube has a minimum ultimate tensile strength of 125,000 psi, yield strength of 115,000 to 135,000 psi, and elongation of 19% for a strip specimen and 15% for a round specimen and a hardness of 30–33 Rockwell C.

2. An electric furnace melted, vacuum degassed high strength weldable seamless tube of wall thickness equal to or greater than 1⅛" which has been heated to an austenization temperature of about 1550° F. and simultaneously internally and externally quenched and tempered at about 1140° F. and has a composition consisting essentially of 0.24 to 0.28% carbon, 1.20 to 1.40% manganese, not more than 0.035% phosphorus, not more than 0.020% sulphur, 0.15 to 0.35% silicon, 0.20 to 0.30% chrominum, not more than 0.05% nickel, 0.40 to 0.60% molybdenum, 0.02 to 0.04% titanium, 0.0007 to 0.0025% boron, 0.007 to 0.050% aluminum and the balance iron and wherein said tube has a minimum ultimate tensile strength of 125,000 psi, yield strength of 115,000 to 135,000 psi, and elongation of 19% for a strip specimen and 15% for a round specimen and a hardness of 30–33 Rockwell C.

* * * * *